US008899253B1

(12) United States Patent
Watson et al.

(10) Patent No.: US 8,899,253 B1
(45) Date of Patent: Dec. 2, 2014

(54) LOCK-N-LEAVE PICNIC TABLE COVER SYSTEM

(71) Applicants: Antonio Watson, Toledo, OH (US); Dana Watson, Toledo, OH (US)

(72) Inventors: Antonio Watson, Toledo, OH (US); Dana Watson, Toledo, OH (US)

( * ) Notice: Subject to any disclaimer, the term of this patent is extended or adjusted under 35 U.S.C. 154(b) by 0 days.

(21) Appl. No.: 13/971,277

(22) Filed: Aug. 20, 2013

(51) Int. Cl.
*E04H 15/40* (2006.01)
*E04H 15/02* (2006.01)

(52) U.S. Cl.
CPC ..... *E04H 15/02* (2013.01); *Y10S 135/913* (2013.01)
USPC ..... 135/125; 135/913

(58) Field of Classification Search
CPC ..... A45F 3/52; A47G 19/26
USPC ..... 135/116, 913, 125; 99/645; 108/90
See application file for complete search history.

(56) References Cited

U.S. PATENT DOCUMENTS

| | | | | | |
|---|---|---|---|---|---|
| 526,942 | A * | 10/1894 | Rhoads et al. | ..... | 135/137 |
| 623,445 | A * | 4/1899 | Van Tuyl | ..... | 135/87 |
| 814,473 | A * | 3/1906 | Patterson | ..... | 135/96 |
| 907,719 | A * | 12/1908 | Berger | ..... | 135/87 |
| 1,437,219 | A * | 11/1922 | Berthon | ..... | 135/132 |
| 4,685,483 | A * | 8/1987 | Balazs | ..... | 135/152 |
| 5,311,813 | A * | 5/1994 | Fairbanks et al. | ..... | 99/645 |
| 5,339,748 | A * | 8/1994 | Bilotti | ..... | 108/90 |
| 5,832,943 | A | 11/1998 | Johnson | | |
| 6,014,935 | A | 1/2000 | Willett | | |
| 6,499,411 | B2 | 12/2002 | Brown | | |
| 8,132,585 | B2 * | 3/2012 | Rothweil | ..... | 135/124 |
| 2003/0106471 | A1 | 6/2003 | Rivers | | |
| 2006/0054208 | A1 | 3/2006 | Romano | | |
| 2006/0081285 | A1 * | 4/2006 | Gomez | ..... | 135/134 |
| 2008/0000398 | A1 | 1/2008 | Barkley | | |
| 2009/0084798 | A1 * | 4/2009 | Rothweil | ..... | 220/666 |
| 2011/0100269 | A1 * | 5/2011 | Hull | ..... | 108/90 |
| 2012/0167934 | A1 * | 7/2012 | Rothweil | ..... | 135/115 |

* cited by examiner

*Primary Examiner* — Noah Chandler Hawk

(74) *Attorney, Agent, or Firm* — RG Patent Consulting, LLC; Rachel Gilboy

(57) ABSTRACT

A picnic table cover system, Lock-N-Leave Coverall™, that can be locked to a picnic table and provide a lockable storage volume for picnic articles and personal items thus protecting them from possible theft while also protecting them from flying insects, pests and ambient weather.

20 Claims, 5 Drawing Sheets

LOCK-N-LEAVE PICNIC TABLE COVER SYSTEM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of covers for a table and more specifically relates to a lock-n-leave picnic table cover system.

DESCRIPTION OF THE RELATED ART

Many families enjoy trips to local, state and national parks to enjoy time away from work, home and the drudgery of everyday life. In recent years, outdoor and offsite picnic entertainment has increased substantially as modern families search for opportunities to have fun time together at a cost that is reasonable and many times at a location close to home. In years past, families would take food, drinks, and board games for forms of entertainment while enjoying the outdoors. These items would be left on a picnic table with little concern for theft, weather conditions or visits from flying insects and other outdoor creatures. Usually, someone would stay close to the picnic table to keep an eye on items left on the picnic table.

In recent times the definition of picnic articles has expanded to include personal items. Since family members want to keep in touch, they are taking more expensive items to their picnic location such as cellular phones, laptops, MP3 players, electronic tablets and other play toys that require some degree of security and protection from changes in weather. A temporary covering of plastic or tarp may provide some protection from the weather, but passers-by can easily lift the covering and help themselves to whatever they find underneath if there isn't someone close by watching the picnic table. Individuals that partake in picnics desire to have something that will help protect their valuables while they are away from the immediate vicinity of the picnic table enjoying a hike or just playing in the surrounding area.

Various attempts have been made to solve the above-mentioned problems such as those found in U.S. Pub. No. 5,832,943 to Edward Wayne Johnson, U.S. Pub No. 2003/0106471 to Nicole Rivers, U.S. Pub No. 2008/0000398 to Victor Barkley, U.S. Pub No. 2006/0054208 to Christopher Romano, U.S. Pat. No. 6,499,411 to Phillip Charles Brown, and U.S. Pat. No. 6,014,935 to Timothy Willett. This art is representative of covers for use with a table. None of the above inventions and patents, taken either singly or in combination, is seen to describe the invention as claimed.

Ideally, a lock-n-leave picnic table cover system should provide a picnic table cover that can be securable by a lock to a picnic table and provides a lockable storage volume for picnic articles, thus protecting them from possible theft while also protecting them from pests and ambient weather conditions and, yet would operate reliably and be manufactured at a modest expense. Thus, a need exists for a reliable lock-n-leave picnic table cover system to avoid the above-mentioned problems.

BRIEF SUMMARY OF THE INVENTION

In view of the foregoing disadvantages inherent in the known table covers art, the present invention provides a novel lock-n-leave picnic table cover system entitled 'Lock-N-Leave Coverall'™. The general purpose of the present invention, which will be described subsequently in greater detail is to provide a picnic table cover that can be securely locked and coupled to the picnic table and thereby provide a lockable storage volume for picnic articles and personal items thus protecting them from possible theft while also protecting them from pests and ambient weather.

A lock-n-leave picnic table cover system is disclosed herein, in a preferred embodiment, comprising a picnic-table-cover-assembly preferably made of (effectively waterproof) nylon material which comprises in combination a table-covering, a canopy-top with an ingress/egress flap (to permit and restrict entry to an inner-volume), a first-support-rod, a second-support-rod, a fastener, and a securer to limit entry to inner volume (when secured/locked).

The table-covering engages above (and around) a picnic-table-top via a table-surface-covering resting on top of the picnic-table-top; the table-surface-covering of sufficient size to completely cover the picnic-table-top. The table-covering comprises a rectangular shape in preferred embodiments able to fit on a rectangular version of a picnic-table-top. Other versions and shapes are available.

The table-covering is securable in a preferred embodiment to the picnic-table-top via inserting a wire through a perimeter-hem located on the perimeter of the table-covering. The wire having a first-end-aperture and a second-end-aperture traverses (is fed) along the perimeter-hem of the table covering until it sticks out on both ends, permitting the picnic-table-cover-assembly to be secured in place via a locking-mechanism. The first-end-aperture and the second-end-aperture are able to be locked together as the first-end-aperture and second-end-aperture create a looped orientation to each other. The first-end-aperture and the second-end-aperture are aligned end-to-end with respect to each other and held together by a locking-mechanism comprising a second-padlock to secure the picnic-table-cover-assembly to the picnic-table-top.

The canopy-top is thereby fixedly attached to the table-surface-covering (not using clamping means), and is comprised of sufficient material to form an inner-volume when in use and is thus able to envelopely-contain picnic-articles placed on the table-covering by a user via an enveloping means.

The first-support-rod and the second-support-rod, each comprising flexible fiberglass material, engage the table-covering and the canopy-top to form the inner-volume comprising a dome (raised portion) when the first-support-rod and the second-support-rod are biased. The dome is formed by pushing the first-support-rod and the second-support-rod against the canopy-top such that the canopy-top is held on a plane above the table-covering during use. The first-support-rod and the second-support-rod each are of sufficient length to form the dome within the canopy-top and to keep it taunt, yet when removed make the device easily storable.

The ingress/egress flap on the canopy-top comprises see through mesh material in preferred embodiments and is able to be opened and alternately closed via the fastener (means) comprising preferably a heavy duty zipper. The fastener, when closed, is lockable via the securer comprising a first-padlock to limit entry to the inner volume. Certain embodiments may comprise only one locking means.

When in use, the user is able to lockably-secure the picnic-table-cover-assembly to the picnic-table-top and is able to place picnic articles on the table-surface-covering via the ingress/egress flap. The user may further secure the ingress/egress flap in a closed condition by closing the ingress/egress flap via the fastener and use the securer to limit entry to the inner volume thus preventing access to the picnic articles when desired, and once unlocked, the user is able to freely access the picnic articles.

A kit is included for the lock-n-leave picnic table cover system including at least one table-covering with the attached canopy-top, at least one first-support-rod, at least one second-support-rod, at least one wire having a first-end-aperture (first end-loop) and a second-end-aperture (second end-loop), at least one securer comprising a first-padlock, at least one locking-mechanism comprising a second-padlock, and at least one set of user-instructions. A method of use for the lock-n-leave picnic table cover system is disclosed herein.

The present invention holds significant improvements and serves as a lock-n-leave picnic table cover system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, lock-n-leave picnic table cover system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a cover for a table and more particularly to a lock-n-leave picnic table cover system as used to improve the ability to safeguard picnic articles and personal items on a picnic table within a lockable storage volume thus protecting them from possible theft while also protecting them from flying pests, other creatures, and ambient weather such as wind or sunlight.

Generally speaking, the lock-n-leave picnic table cover system provides security and peace of mind for picnickers. It provides a picnic table covering that is securable to a picnic table via a locking system and a lockable storage canopy that opens up on the top of the picnic table which is useful for lockably storing valuables. This product can be manufactured with various designs ranging from a basic rectangular shape and a basic round shape to other novelty shapes including sports shapes such as a baseball, basketball, football and vehicle shapes such as custom cars and trucks. Each of these functional designs appeal to picnickers wanting to make a fashion statement while enjoying themselves at a park.

Figure 1:
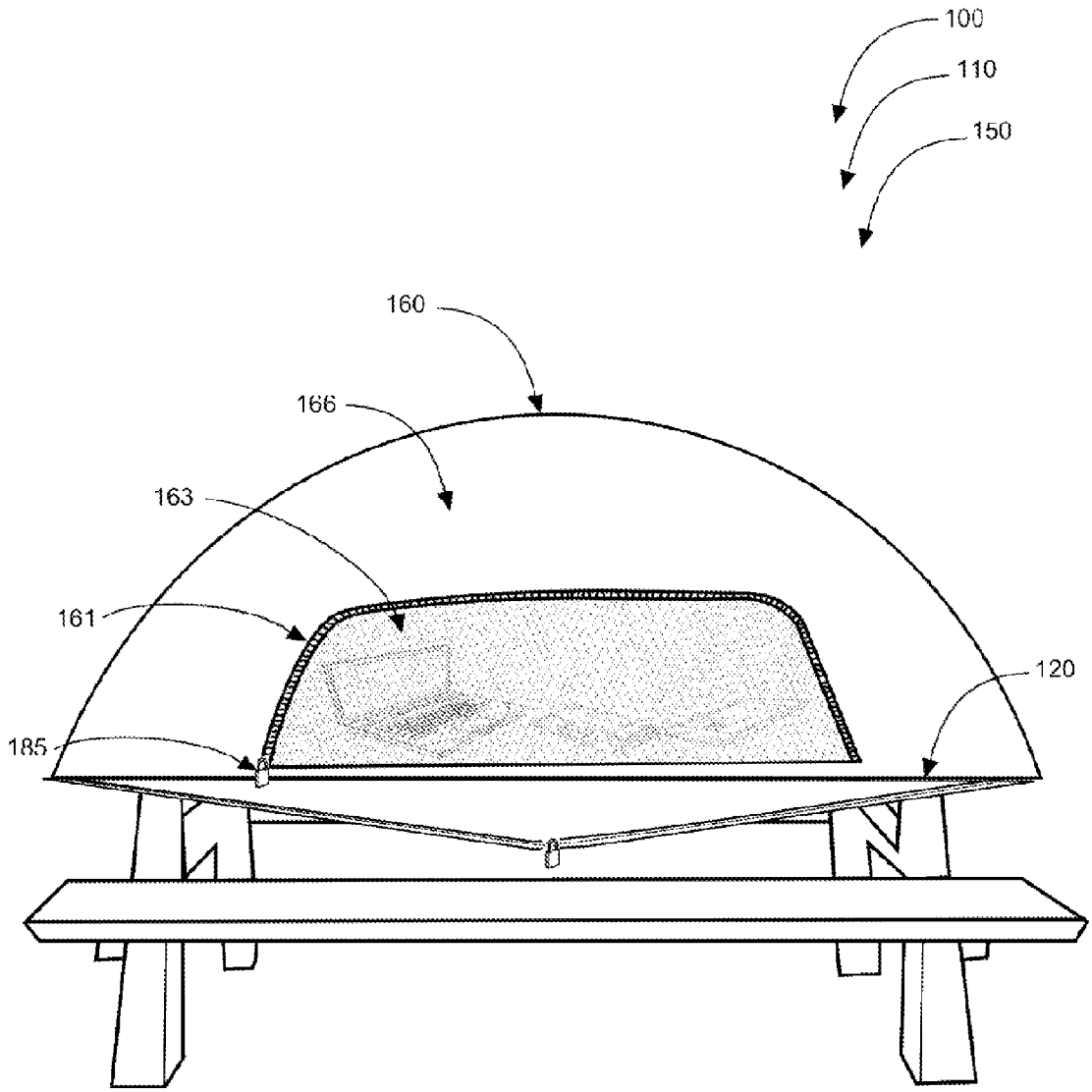
FIG. 1 shows a perspective view illustrating a lock-n-leave picnic table cover system in an in-use condition according to an embodiment of the present invention.

Referring to the drawings by numerals of reference there is shown in FIG. 1, a perspective view illustrating lock-n-leave picnic table cover system 100 in an in-use condition 150 according to an embodiment of the present invention.

Lock-n-leave picnic table cover system 100 comprises picnic-table-cover-assembly 110 of waterproof nylon material which comprises in combination table-covering 120, canopy-top 160 with ingress/egress flap 163 (to permit and restrict entry to inner-volume 166), first-support-rod 170, second-support-rod 175, fastener 161, and securer 185 to limit entry to inner volume 166.

When in use, a user is able to lockably-secure picnic-table-cover-assembly 110 to picnic-table-top 105 and is able to place picnic articles such as cooking utensils and personal items such as wallets, purses, cellular phones, and laptops (as shown) on table-surface-covering 122 via ingress/egress flap 163. The user may further secure ingress/egress flap 163 in a closed condition by closing ingress/egress flap 163 via fastener 161 and use securer 185 to limit entry to inner volume 166 to prevent access to the picnic articles and personal items when desired, and once unlocked, the user is able to access the picnic articles and personal items.

Figure 2:
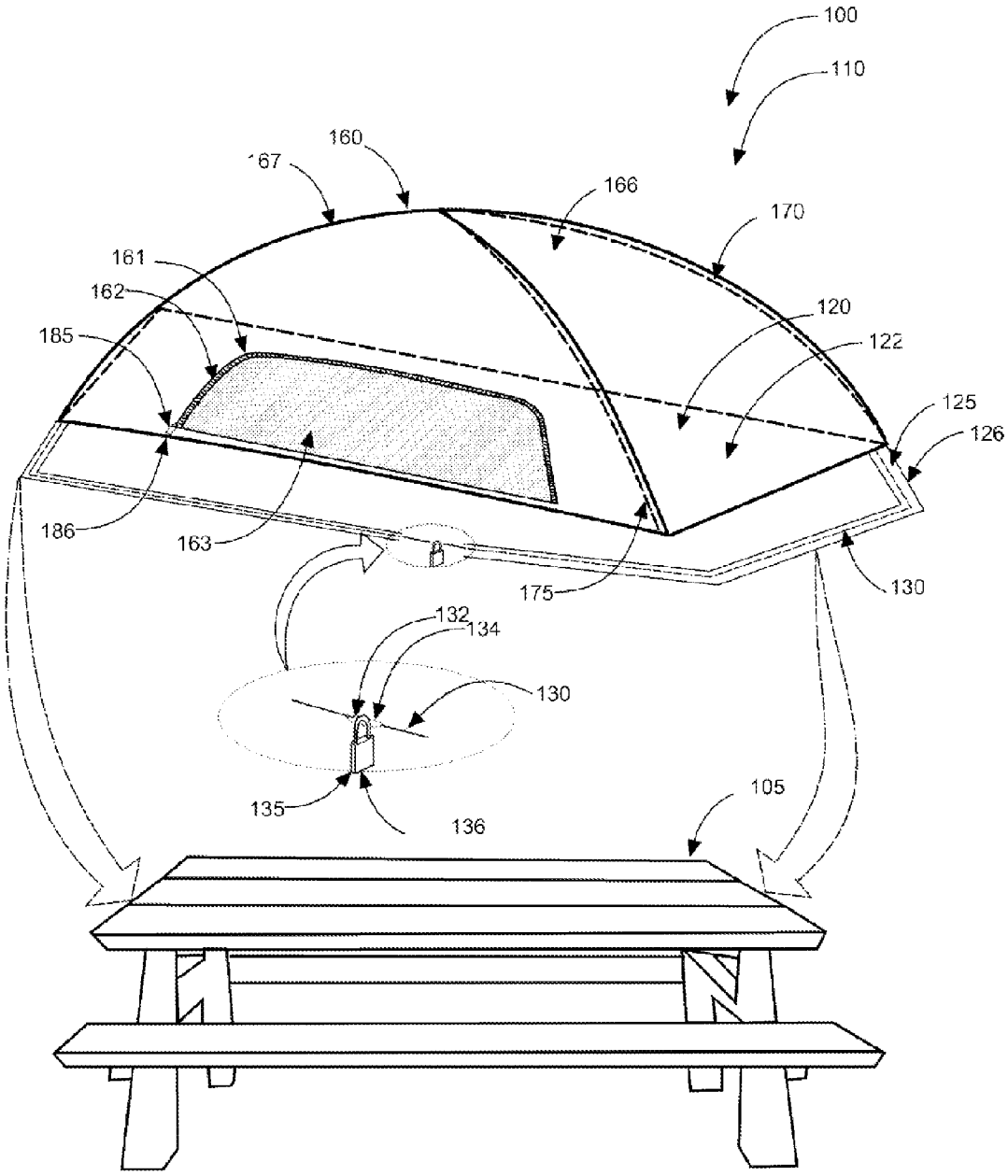
FIG. 2 is a perspective view illustrating the lock-n-leave picnic table cover system ready for coupled placement on a picnic table top according to an embodiment of the present invention of FIG. 1.

Referring now to FIG. 2, a perspective view illustrating lock-n-leave picnic table cover system 100 ready for (couplable) placement on picnic-table-top 105 according to an embodiment of the present invention of FIG. 1.

Picnic-table-cover-assembly 110 comprises effectively waterproof nylon-material, as previously mentioned; however other suitable materials may be used. Table-covering 120 engages above picnic-table-top 105 via table-surface-covering 122 resting on top of picnic-table-top 105 and is of sufficient size to completely cover picnic-table-top 105 when in use. Table-covering 120 comprises a rectangular shape in these embodiments such that it is able to fit on a rectangular version of picnic-table-top 105. Other non-rectangular versions are shown in FIG. 3.

Canopy-top 160 is fixedly attached to table-surface-covering 122, and is comprised of sufficient material to form inner-volume 166 when in use and is able to contain picnic articles and personal items placed on table-covering 120 (as shown in FIG. 1) by a user via an enveloping means. First-support-rod 170 and second-support-rod 175 each preferably comprise flexible fiberglass material engage table-covering 120 and canopy-top 160 to form inner-volume 166 comprising dome 167 when first-support-rod 170 and second-support-rod 175 are biased. Dome 167 is formed by pushing first-support-rod 170 and second-support-rod 175 against canopy-top 160 such that canopy-top 160 is held on a plane above table-covering 120 while in use; first-support-rod 170 and second-support-rod 175 in tension. First-support-rod 170 and second-support-rod 175 each are of sufficient length to form dome 167 within canopy-top 160. Ingress/egress flap 163 on canopy-top 160 may comprise see-through (transparent/clear) mesh material such that items can be viewed (other versions may be opaque) and is opened and alternately closed via fastener 161 comprising a heavy duty zipper 162. Fastener 161, when closed, is lockable via securer 185 comprising first-padlock 186 to limit entry to inner volume 166.

Figure 3:
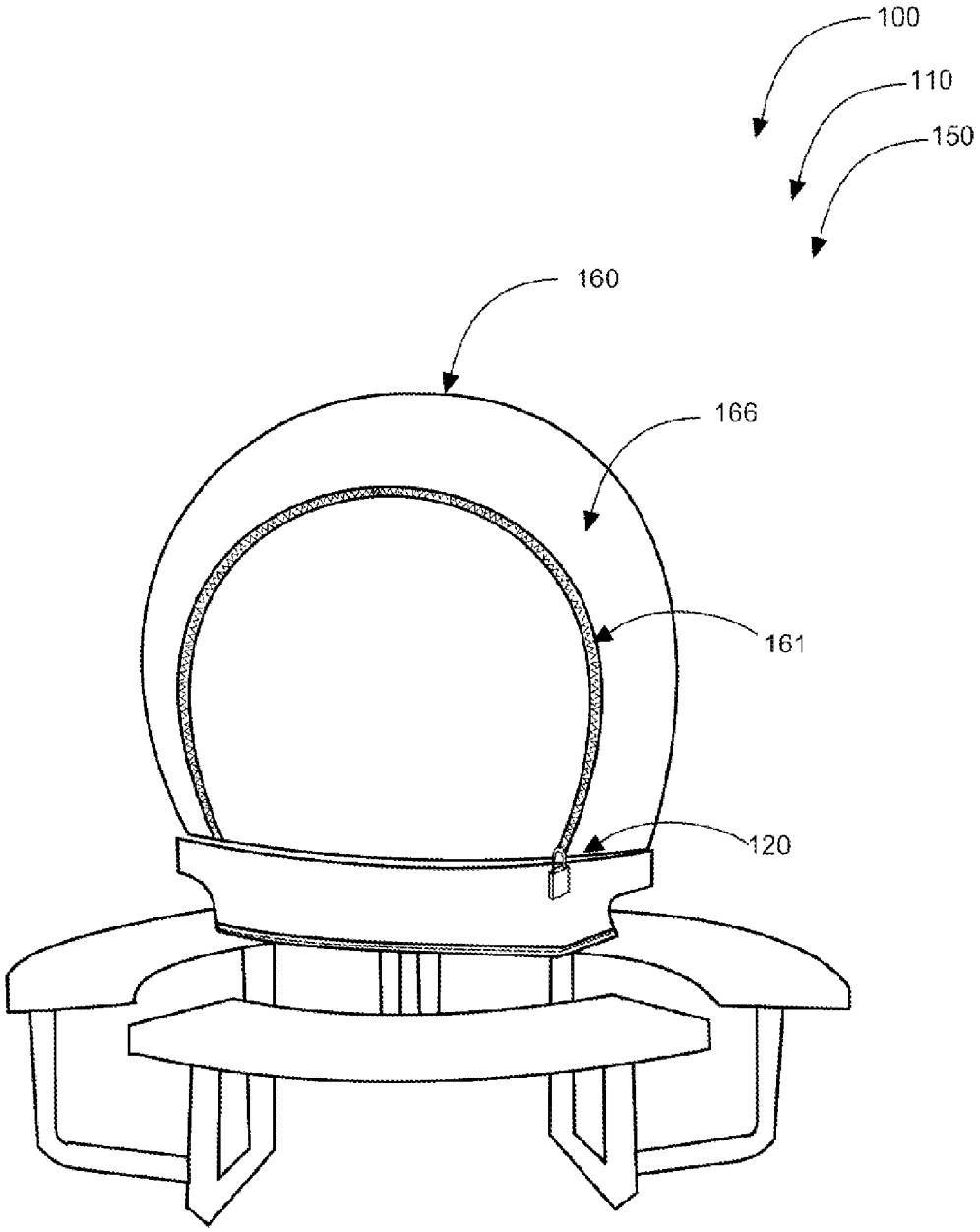
FIG. 3 is a perspective view illustrating the lock-n-leave picnic table cover system for a round version of a picnic table according to an embodiment of the present invention of FIG. 1.

Referring now to FIG. 3, a perspective view illustrating lock-n-leave picnic table cover system 100 in an in-use condition 150 for a round version of a picnic table according to an embodiment of the present invention of FIG. 1.

In an alternate embodiment lock-n-leave picnic table cover system 100 table-covering 120 comprises a round shape able to fit on a round version of picnic-table-top 105. Other embodiments of lock-n-leave picnic table cover system 100 may be configured to resemble sports novelties such as baseballs, basketballs, footballs and the like, and shapes such as sports cars, pickup trucks and the like, and other shapes as desired.

Figure 4:
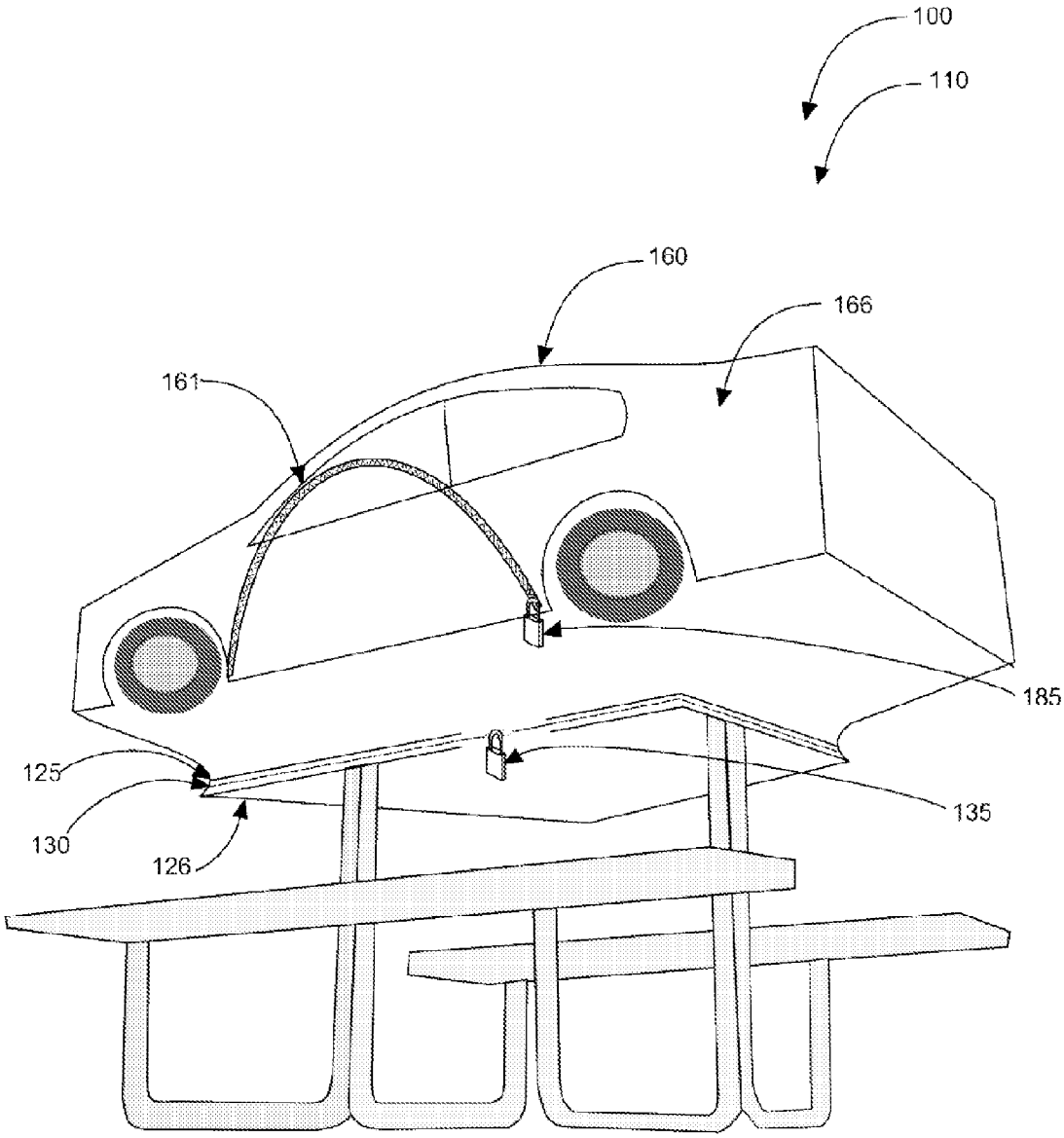
FIG. 4 is a perspective view illustrating an underside view of the lock-n-leave picnic table cover system according to an embodiment of the present invention of FIG. 1.

Referring now to FIG. 4, a perspective view illustrating an underside view of lock-n-leave picnic table cover system 100 according to an embodiment of the present invention of FIG. 1 with picnic-table-cover-assembly 110 resembling a sports car.

Table-covering 120 is secured to picnic-table-top 105 via inserting wire 130 through perimeter-hem 125 located on perimeter 126 of table-covering 120. Wire 130 traverses along (within) perimeter-hem 125, permitting picnic-table-cover-assembly 110 to be secured in place via locking-mechanism 135 comprising second-padlock 136. Wire 130 comprises first-end-aperture 132 and second-end-aperture 134 with first-end-aperture 132 and second-end-aperture 134 able to be locked together as first-end-aperture 132 and second-end-aperture 134 form a looped orientation to each other. First-end-aperture 132 and second-end-aperture 134 are aligned end-to-end with respect to each other and held together by locking-mechanism 135 to secure picnic-table-cover-assembly 110 to picnic-table-top 105.

Lock-n-leave picnic table cover system 100 may be sold as kit 440 comprising the following parts: at least one table-covering 120 with attached canopy-top 160, at least one first-support-rod 170, at least one second-support-rod 175, at least one wire 130 having first-end-aperture 132 and second-end-aperture 134, at least one securer 185 comprising first-padlock 186, at least one locking-mechanism 135 comprising second-padlock 136, and at least one set of user-instructions. The kit has instructions such that functional relationships are detailed in relation to the structure of the invention (such that the invention can be used, maintained, or the like in a preferred manner). Lock-n-leave picnic table cover system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different functional design combinations, parts may be sold separately, etc., may be sufficient.

Figure 5:
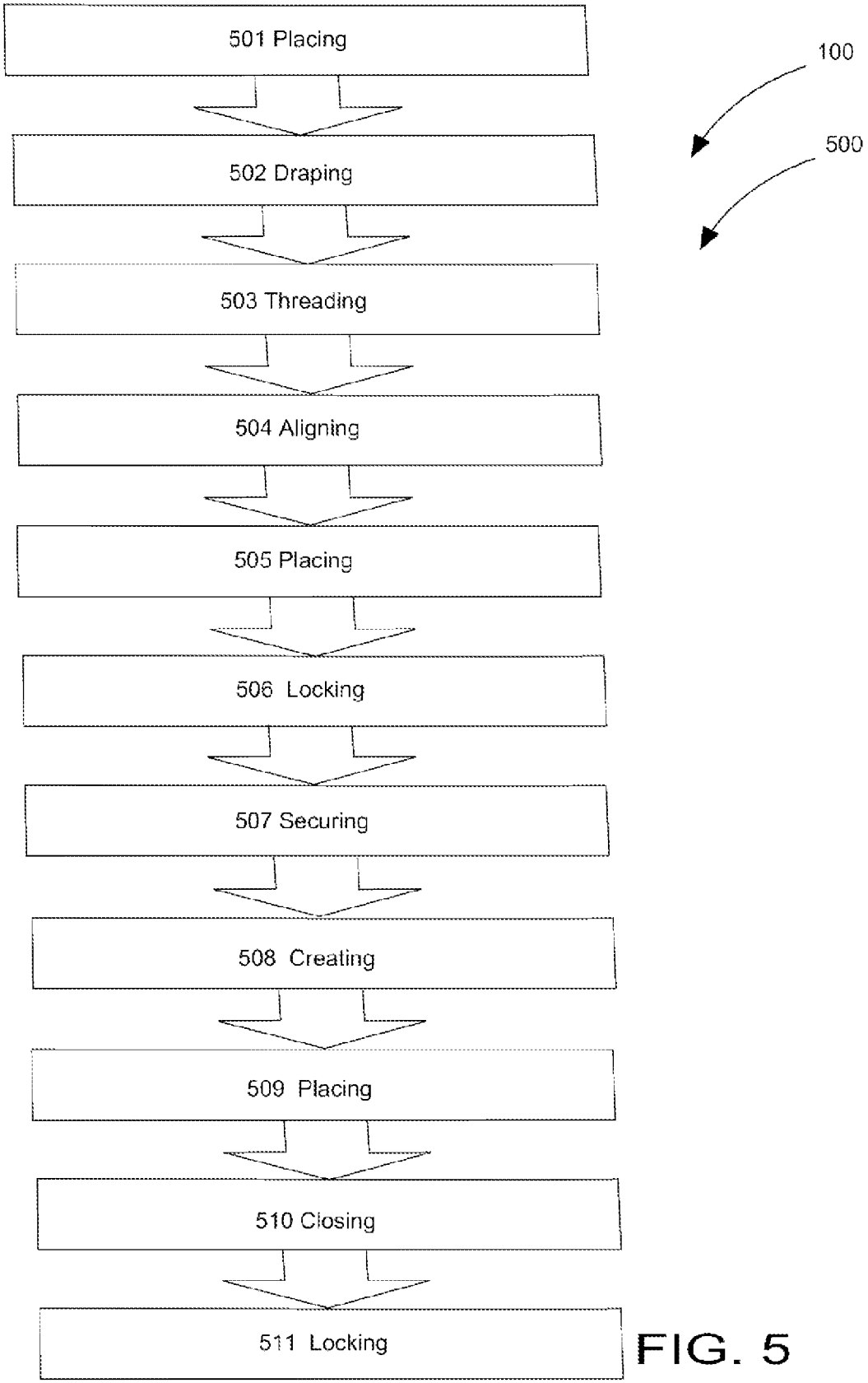
FIG. 5 is a flowchart illustrating a method of use for the lock-n-leave picnic table cover system according to an embodiment of the present invention of FIGS. 1-4.

Referring now to FIG. 5, a flowchart illustrating a method of use 500 for lock-n-leave picnic table cover system 100 according to an embodiment of the present invention of FIGS. 1-4.

Method of use 500 for lock-n-leave picnic table cover system 100 may comprise the steps of step one 501 placing table-covering 120 with attached canopy-top 160 on picnic-table-top 105, step two 502 draping edges of table-covering 120 over ends and sides of picnic-table-top 105, step three 503 threading wire 130 through perimeter-hem 125 leaving first-end-aperture 132 and second-end-aperture 134 on an outside of each end of perimeter-hem 125, step four 504 aligning first-end-aperture 132 and second-end-aperture 134 in relation to each other, step five 505 placing locking-mechanism 135 through first-end-aperture 132 and aligned second-end-aperture 134, step six 506 locking locking-mechanism 135, step seven 507 securing table-covering 120 to picnic-table-top 105 via inserting first-support-rod 170 and second-support-rod 175 into canopy-top 160, step eight 508 creating inner-volume 166 by placing first-support-rod 170 and second-support-rod 175 in appropriate corners of canopy-top 160 (and biasing them), step nine 509 placing picnic-articles and personal items within inner-volume 166 via ingress-egress flap 163, step ten 510 closing ingress-egress flap 163 using fastener 161, and step eleven 511 locking fastener 161 with securer 185 to limit entry to inner-volume 166.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A lock-n-leave picnic table cover system comprising:

a picnic-table-cover-assembly comprising;

a table-covering;

a canopy-top with an ingress/egress flap to permit and restrict entry to an inner-volume;

a first-support-rod;

a second-support-rod;

a fastener; and a securer to limit said entry to said inner volume;

wherein said lock-n-leave picnic table cover system comprises said picnic-table-cover-assembly;

wherein said picnic-table-cover-assembly comprises in combination said table-covering, said canopy-top with said ingress/egress flap, said first-support-rod, said second-support-rod, said fastener, and said securer;

wherein said table-covering engages and encloses above a picnic-table-top via a table-surface-covering resting on top of said picnic-table-top;

wherein said table-covering is of sufficient size to completely cover said picnic-table-top;

wherein said canopy-top is fixedly attached to said table-surface-covering;

wherein said first-support-rod and said second-support-rod are biasingly-used to form said inner-volume by pushing against said canopy-top such that said canopy-top is held above said table-covering during use;

wherein said fastener when closed is lockable via said securer to limit said entry to said inner volume;

wherein said table-covering is secured to said picnic-table-top via inserting a wire through a perimeter-hem located on a perimeter of said table-covering to traverse along said perimeter-hem, permitting said picnic-table-cover-assembly to be secured in place via a locking-mechanism;

wherein a user is able to lockably-secure said picnic-table-cover-assembly to said picnic-table-top; and wherein said user is able to place picnic articles and personal items on said table-surface-covering via said ingress/egress flap and secure said ingress/egress flap in a closed condition by closing said ingress/egress flap via said fastener and using said securer to limit said entry to said inner volume to prevent access to said picnic articles and personal items when desired.

2. The lock-n-leave picnic table cover system, of claim 1 wherein said picnic-table-cover-assembly comprises nylon-material.

3. The lock-n-leave picnic table cover system, of claim 2 wherein said picnic-table-cover-assembly is effectively waterproof.

4. The lock-n-leave picnic table cover system, of claim 3 wherein said table-covering comprises a rectangular shape able to fit on a rectangular version of said picnic-table-top.

5. The lock-n-leave picnic table cover system, of claim 3 wherein said table-covering comprises a round shape able to fit on a round version of said picnic-table-top.

6. The lock-n-leave picnic table cover system, of claim 1 wherein said canopy-top, when used, is comprised of sufficient material to form said inner-volume able to contain said picnic-articles placed on said table-covering via an enveloping means.

7. The lock-n-leave picnic table cover system, of claim 6 wherein said inner-volume comprises a dome when used.

8. The lock-n-leave picnic table cover system, of claim 1 wherein said first-support-rod and said second-support-rod comprise flexible fiberglass material.

9. The lock-n-leave picnic table cover system, of claim 8 wherein said first-support-rod and said second-support-rod are of sufficient length to form said dome within said canopy-top via being biased in tension.

10. The lock-n-leave picnic table cover system, of claim 9 wherein said first-support-rod and said second-support-rod engage said table-covering and said canopy-top to form said dome when said first-support-rod and said second-support-rod are biased.

11. The lock-n-leave picnic table cover system, of claim 1 wherein said ingress/egress flap comprises see through mesh material.

12. The lock-n-leave picnic table cover system, of claim 11 wherein said ingress/egress flap is opened and alternately closed via said fastener.

13. The lock-n-leave picnic table cover system, of claim 12 wherein said fastener, when closed, is lockable via said securer to limit said entry to said inner volume.

14. The lock-n-leave picnic table cover system, of claim 13 wherein said fastener comprises a heavy duty zipper.

15. The lock-n-leave picnic table cover system, of claim 1 wherein said securer comprises a first-padlock.

16. The lock-n-leave picnic table cover system, of claim 1 wherein said wire traversing through said perimeter-hem comprises a first-end-aperture and a second-end-aperture able to be locked to said picnic-table-top via said first-end-aperture and said second-end-aperture in a looped orientation to each other.

17. The lock-n-leave picnic table cover system, of claim 16 wherein said first-end-aperture and said second-end-aperture are aligned end-to-end with respect to each other and held together by said locking-mechanism comprising a second-padlock to secure said picnic-table-cover-assembly to said picnic-table-top.

18. A lock-n-leave picnic table cover system, comprising:

a picnic-table-cover-assembly comprising;

a table-covering;

a canopy-top with an ingress/egress flap to permit and restrict entry to an inner-volume;

a first-support-rod;

a second-support-rod;

a fastener; and a securer to limit said entry into and out of said inner volume;

wherein said lock-n-leave picnic table cover system comprises said picnic-table-cover-assembly;

wherein said picnic-table-cover-assembly does not use clamp holders to be secured in place;

wherein said picnic-table-cover-assembly comprises in combination said table-covering, said canopy-top with said ingress/egress flap, said first-support-rod, said second-support-rod, said fastener, and said securer;

wherein said picnic-table-cover-assembly comprises nylon-material;

wherein said picnic-table-cover-assembly is effectively waterproof;

wherein said table-covering engages and encloses above a picnic-table-top via a table-surface-covering resting on top of said picnic-table-top;

wherein said table-covering is of sufficient size to completely cover said picnic-table-top;

wherein said table-covering comprises a rectangular shape able to fit on a rectangular version of said picnic-table-top;

wherein said table-covering is secured to said picnic-table-top via inserting a wire through a perimeter-hem located on a perimeter of said table-covering to traverse along said perimeter-hem, permitting said picnic-table-cover-assembly to be secured in place via a locking-mechanism;

wherein said wire traversing through said perimeter-hem comprises a first-end-aperture and a second-end-aperture able to be locked to said picnic-table-top via said first-end-aperture and said second-end-aperture in a looped orientation to each other;

wherein said first-end-aperture and said second-end-aperture are aligned end-to-end with respect to each other and held together by said locking-mechanism comprising a second-padlock to secure said picnic-table-cover-assembly to said picnic-table-top;

wherein said canopy-top is fixedly attached to said table-surface-covering;

wherein said canopy-top, when used, is comprised of sufficient material to form said inner-volume able to contain said picnic-articles and said personal items placed on said table-covering via an enveloping means;

wherein said first-support-rod and said second-support-rod are biasingly-used to form said inner-volume by pushing against said canopy-top such that said canopy-top is held on a plane above said table-covering during use;

wherein said inner-volume comprises a dome when used;

wherein said first-support-rod and said second-support-rod comprise flexible fiberglass material;

wherein said first-support-rod and said second-support-rod are of sufficient length to form said dome within said canopy-top via being biased in tension;

wherein said first-support-rod and said second-support-rod engage said table-covering and said canopy-top to form said dome when said first-support-rod and said second-support-rod are biased;

wherein said ingress/egress flap comprises see through mesh material;

wherein said ingress/egress flap is opened and alternately closed via said fastener;

wherein said fastener, when closed, is lockable via said securer to limit said entry to said inner volume;

wherein said fastener comprises a heavy duty zipper;

wherein said securer comprises a first-padlock;

wherein a user is able to lockably-secure said picnic-table-cover-assembly to said picnic-table-top; and wherein said user is able to place picnic-articles and personal items on said table-surface-covering via said ingress/egress flap and secure said ingress/egress flap in a closed condition by closing said ingress/egress flap via said fastener and using said securer to limit said entry to said inner volume to prevent access to said picnic-articles and said personal items when desired and once unlocked said user is able to access said picnic-articles and said personal items.

19. The lock-n-leave picnic table cover system of claim 18 wherein said picnic-table-cover-assembly comprises a kit having said table-covering with attached said canopy-top, said first-support-rod, said second-support-rod, said wire having said first-end-aperture and said second-end-aperture, said securer comprising said first-padlock, said locking-mechanism comprising said second-padlock; and at least one set of user-instructions.

20. A method of using a lock-n-leave picnic table cover system comprising the steps of:

placing a table-covering with an attached canopy-top on a picnic-table-top;

draping edges of said table-covering over ends and sides of said picnic-table-top;

threading wire through a perimeter-hem leaving a first-end-aperture and a second-end-aperture on an outside of each end of said perimeter-hem;

aligning said first-end-aperture and said second-end-aperture in relation to each other;

placing a locking-mechanism through said first-end-aperture and aligned said second-end-aperture;

locking said locking-mechanism;

securing said table-covering to said picnic-table-top via inserting first-support-rod and second-support-rod into said canopy-top;

creating an inner-volume by placing said first-support-rod and said second-support-rod in appropriate corners of said canopy-top;

placing picnic-articles and personal items within said inner-volume via ingress-egress flap;

closing said ingress-egress flap using fastener; and locking said fastener with a securer to limit entry to said inner-volume.

* * * * *